US005725038A

United States Patent [19]

Tucker et al.

[11] Patent Number: 5,725,038

[45] Date of Patent: Mar. 10, 1998

[54] ROUTER BASEPLATE AND TABLE

[75] Inventors: Edwin C. Tucker, Ottawa; Lloyd Sevack, Nepean, both of Canada

[73] Assignee: Lee Valley Tools Ltd., Ottawa, Canada

[21] Appl. No.: 705,319

[22] Filed: Aug. 29, 1996

[51] Int. Cl.[6] ..... B27M 1/00; B27C 5/02; B25H 1/00

[52] U.S. Cl. ..... 144/371; 144/134.1; 144/135.2; 144/286.1; 144/329; 144/371; 29/522.1; 29/524

[58] Field of Search ..... 144/1.1, 82, 70, 144/83, 134.1, 135.2, 136.95, 154.5, 286.1, 286.5, 371, 329; 409/180, 181, 182, 183; 29/700, 521, 522.1, 524

[56] References Cited

U.S. PATENT DOCUMENTS

| | | | |
|---|---|---|---|
| 2,615,479 | 10/1952 | Bearup | 144/135.2 |
| 2,776,682 | 1/1957 | Mullen | 144/135.2 |
| 5,025,841 | 6/1991 | Totten | 144/1.1 |
| 5,289,861 | 3/1994 | Hedrick | 144/135.2 |
| 5,398,740 | 3/1995 | Miller | 144/1.1 |

OTHER PUBLICATIONS

"CMT Tools Catalog 18, 1995–96, p. 44."

Highland Hardware Early Fall 1993 Sale Catalog, pp. 46–48.

Lee Valley Catalog entitled *Fine Woodworking Tools* 1991–92, p. 108.

McFeely's Square Drive Screws Catalog, ©1995 McFeely's, pp. 60–61.

The Woodworkers' Store® 1993–1994 Catalog #C–93, pp. 99–100.

Trend–lines® Woodworkers Warehouse™ Catalog 508H, ©1993 Trend–Lines, Inc., pp. 10,42.

Woodcraft® Jan. 1996 Catalog, p. 74.

Woodhaven Catalog entitled *Uncommon Woodworking Tools*, ©1995, Woodhaven, Inc., pp. 3, 5, 10–13.

Woodworker's Supply, Inc., Catalog #76, Aug. 1992, p. 36.

*Primary Examiner*—W. Donald Bray

*Attorney, Agent, or Firm*—John S. Pratt; Kilpatrick Stockton LLP

[57] ABSTRACT

A router baseplate and router table, and a method for accurately mounting the baseplate on a router base and machining table top material to receive the baseplate so that the router may be used suspended upside down in the table top. The router baseplate is a relatively thin plate centered on the router collet that remains attached to the router for free hand use and that is received snugly in a hole in the table top supported by a ledge adjacent to the hole. Two opposed sections of the ledge are omitted so that the router and baseplate can be installed in the table top from the bottom of the table top by tilting the router and baseplate, sliding the baseplate through the openings in the ledge, and then untilting the router and seating the baseplate edge on the ledge. Movement during use in the tabletop is limited by a pin fixed in the baseplate and received in a recess in the ledge.

23 Claims, 6 Drawing Sheets

FIG 1

ROUTER BASEPLATE AND TABLE

FIELD OF THE INVENTION

This invention relates to routers and router tables used in woodworking.

BACKGROUND OF THE INVENTION

Because of their versatility, electric routers are very widely used in woodworking, particularly in home and small commercial shops. Such routers use a powerful electric motor in a housing to which handles are attached, or which is received in a base to which handles are attached, for holding and manipulating the tool. The motor shaft terminates in a collet adapted to receive the shank of a router bit or cutter, and a base attaches to the housing and surrounds the cutter so that a portion of the cutter may protrude beyond the base, which bears against a workpiece during use of the router. The position of the base is adjustable up and down parallel to the rotating axis of the collet and cutter, and in plunge routers the relative position of the base and router cutter can change during use of the tool in order to "plunge" the cutter into the workpiece. Electric routers are generally intended to be used by "free hand" moving the router relative to a stationary workpiece with a portion of the router base bearing against the workpiece.

Substantial additional versatility can be achieved by mounting a router in an inverted position with the router cutter protruding up through an opening in a relatively large flat work surface to provide, in effect, a shaper. With this arrangement, a workpiece lying on top of the work surface can be manipulated relative to the stationary router and a rotating router cutter the position of which that does not move relative to the workpiece. Such router tables are commercially available in a variety of configurations, and numerous plans for homemade router tables are also available.

A number of problems are associated with existing router tables. For instance, phenolic or other plastic plates to which the router is attached in some router tables sag from the weight of the router over a period of time, in part because the plates must be fairly large to permit "drop-in" installation of the router through an opening in the router table top that will clear the entire router, including handles. Other configurations that use smaller baseplates to which the router base is attached after removing the factory supplied baseplate require the router to be mounted in the router table top by passing screws through the table top or substitute baseplate and into the router base while the router is held in position below the table top. This is difficult and time consuming. Some existing router table designs do not easily accommodate all of the many routers on the market, or accommodate them only with an undesirably large number of holes in the router table top. Each hole in a router table top may catch chips that block or mar a workpiece, and rough hole edges can also damage a workpiece.

Many existing attachment arrangements make it time consuming to remove and replace a router, or make it very time consuming to switch from use of the router in a router table to conventional use of it with a baseplate. It is also frequently difficult to remove and replace cutters in routers mounted in existing router tables. Furthermore, many of the baseplates to which routers are attached for use in a router table are undesirable for use as a baseplate during free hand router operation because they are not round or because the router is not accurately mounted relative to the baseplate edge. Even factory-supplied round bases often are not mounted concentric with the router collet.

BRIEF DESCRIPTION OF THE INVENTION

The router baseplate of the present invention is a relatively large diameter round, typically plastic, disk affixed to the router base, centered on the router collet, and typically held in place with the same screws that secured the factory-supplied baseplate. The baseplate disk is sufficiently large in diameter to project beyond the router base around its entire periphery. The router may be used with the baseplate affixed to the router base in conventional "free hand" routing operations where the router is moved relative to a workpiece. Additionally, the router may be suspended upside down from a router table top for operations in which the workpiece is moved relative to a stationary router.

For such router table use the router is suspended with the baseplate positioned within a hole in a router table top just slightly larger than the baseplate and resting on a lip or ledge located a distance below the top surface of the table top equal to the thickness of the baseplate. Two opposed segments of the ledge are removed so that the router can be installed from under the top by tilting the router and baseplate, sliding the baseplate through the openings in the ledge, and then untilting the router and seating the baseplate edge on the ledge. By installing and removing the router and baseplate from underneath the table top, the baseplate and the hole in this top that receives it need not be large enough to clear the entire router, including its handles, and the power cord need not be fed through the table top opening. Since the baseplate is "widest" at the geometric chord passing through its center (i.e., the diameter) and its "width" rapidly diminishes along parallel chords subtending progressively smaller arcs of the circular baseplate, only a relatively small portion of the baseplate requires more clearance than that afforded by the ledge that supports the baseplate, and little lateral movement is required before the router can be untilted and the baseplate seated in the top. Rotation of the router and baseplate within the top during use is prevented by a neoprene or rubber covered pin projecting from the underside of the baseplate near the baseplate edge, which pin is received in an arcuate recess in the ledge. This "soft" pin also pushes the baseplate toward the opposite side of the ledge, thus eliminating any free play that might otherwise occur as a result of clearance between the baseplate diameter and the diameter of the hole in the table top that receives the baseplate.

The router baseplate is mounted on the router utilizing a baseplate template and an alignment pin in the router collet to mark screw hole locations on the baseplate and a countersink bit or other approximate tooling to drill holes for flathead screws to pass through the baseplate and into the router base.

A trammel bar is then used to accurately locate and drill two small holes near the baseplate edge. Then the router is used with the baseplate attached to machine in suitable router table top material such as plywood, particle board or fiber board a stepped opening for the baseplate to fit within, notches for the baseplate to pass through and a semi-circular or arcuate cut-out to receive a rotation limiting pin fixed in the small hole nearest the baseplate edge.

In an alternative embodiment of the present invention the substitute baseplate is not round but is instead any of a variety of other shapes, particularly including square or rectangular, and the opening in the router table top matches this alternative shape. While such non-round shapes preclude use without modification of the table top machining method of the present invention, notches frequently are not necessary to permit installation of the router and baseplate assembly in the table top from below the table top because the baseplate can be passed through the diagonal of a square or rectangular opening with some rotation of the baseplate to clear its corners.

It is therefore an object of the present invention to provide a router baseplate and router table structure that facilitates very quick mounting of the router in, and removal of the router from, the router table to permit rapid alternation between router table and free hand operation using the same baseplate.

It is a further object of the present invention to provide a method of quickly and accurately mounting a round router baseplate concentric with the router collet.

It is another object of the present invention to provide a router table top that will permit the quick installation and removal of the baseplate from the underside of the table top.

It is a further object of the present invention to provide a router table top that will permit the installation and removal of the baseplate from the underside of the table top without the need to pass the router power cord through the opening in the table top.

It is an additional object of the present invention to provide a router table top that does not have numerous holes or slots in the top which might nick a workpiece or otherwise detract from functionality of the top.

It is another object of the present invention to provide a method for easily and accurately machining a router table top to receive a round router baseplate, and to successfully machine the router table top in a manner that does not require that the baseplate be mounted on the router concentric with the router collet.

It is a further object of the present invention to provide a router table top that provides easy accessibility of the router collet for changing router cutters.

These and other objects of the present invention will be readily understood by those skilled in the art by reference to the following detailed descriptions of the invention, the claims and the accompanying drawings.

DETAILED DESCRIPTION OF THE DRAWINGS

Figure 1:
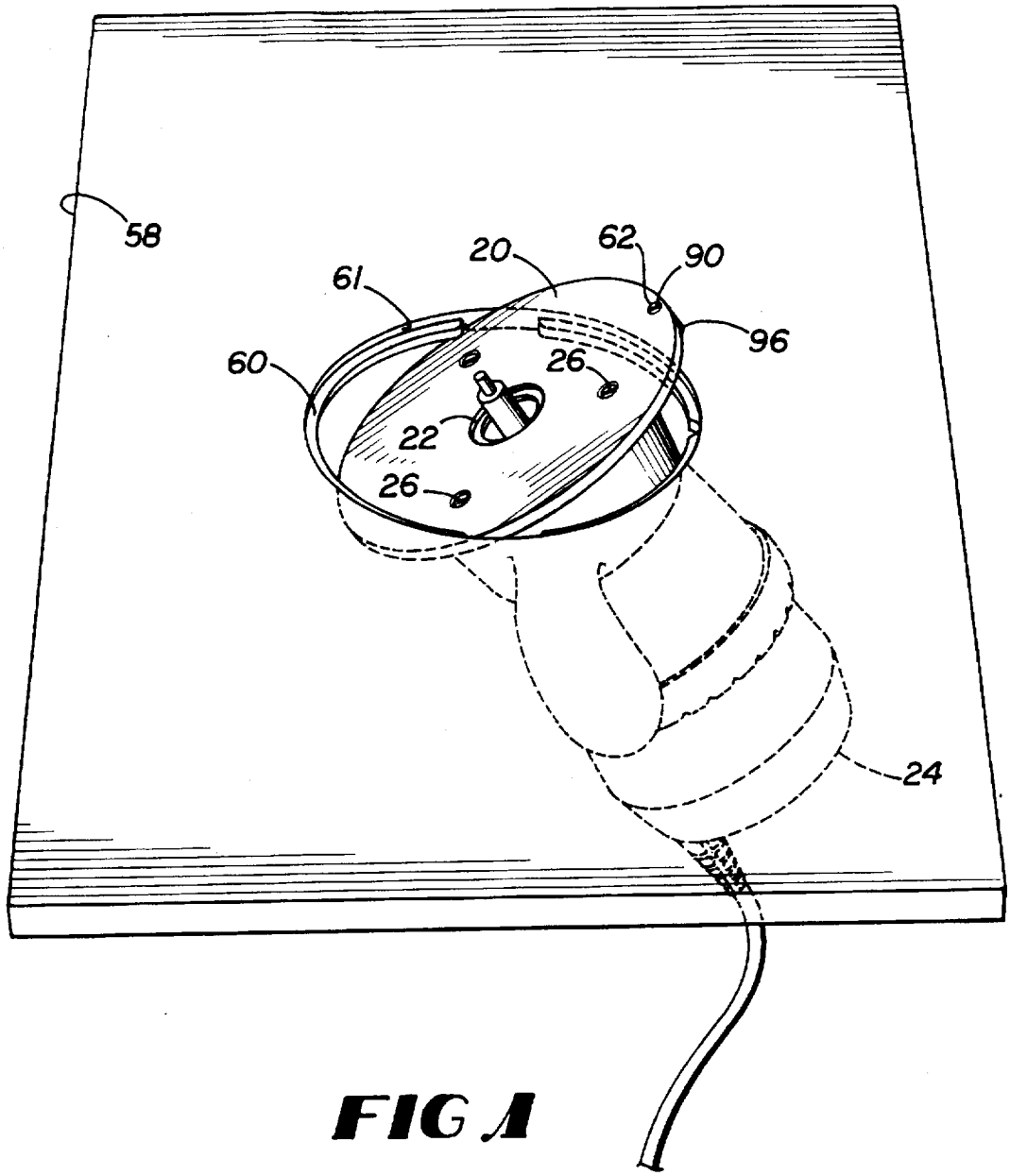
FIG. 1 is a perspective view of the router baseplate and router table top of the present invention shown during the process of installing the router in or removing the router from the table top.

As is illustrated in FIG. 1, the router baseplate 20 of the preferred embodiment of the present invention is a flat, round plate penetrated by a stepped, centered hole 22. Baseplate 20 is affixed to the bottom of a router 24 with flat head screws 26 that pass through the baseplate 20 and into threaded holes (not visible in FIG. 1) in the router 24.

Figure 2:
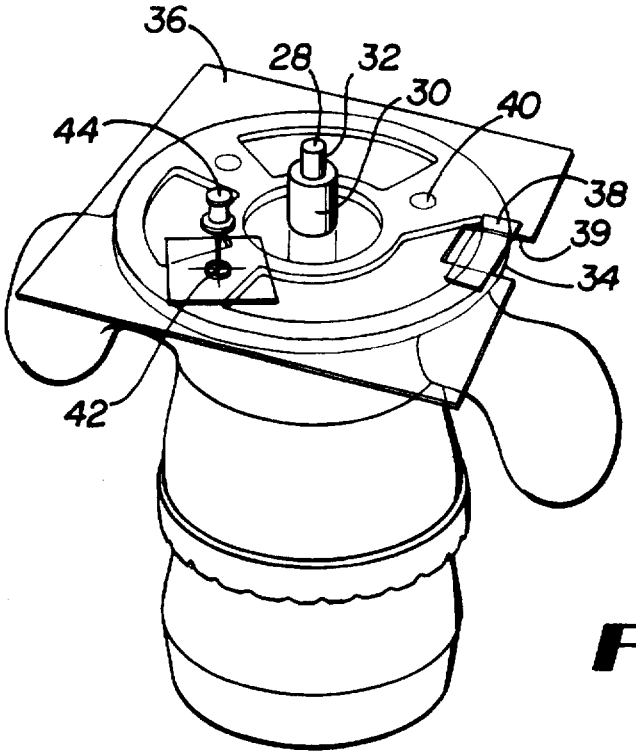
FIG. 2 is a perspective view of the underside of a router showing use of the template and alignment pin of the present invention to transfer the locations of baseplate screw holes in the router base to the template.
Figure 3:
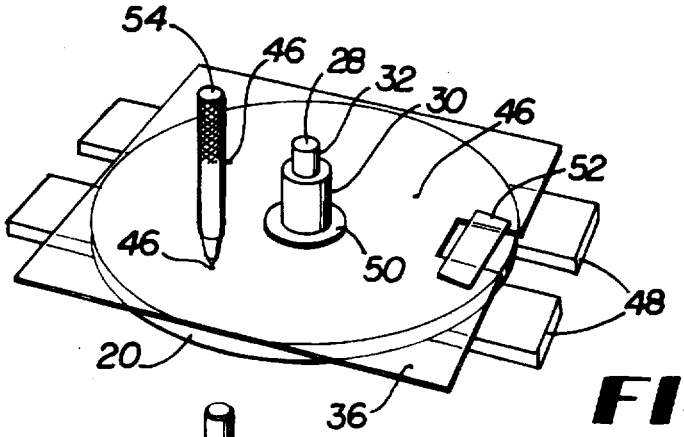
FIG. 3 is a perspective view of the template of the present invention positioned on the baseplate of the present invention illustrating transfer of screw hole locations to the router base plate.
Figure 4:
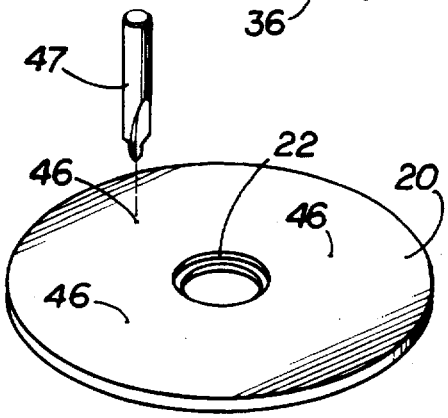
FIG. 4 is a perspective view of the baseplate of the present invention ready for machining countersunk screw holes for receiving baseplate screws.

Baseplate 20 may be prepared for mounting on router 24 utilizing the steps illustrated in FIGS. 2, 3 and 4. First, an alignment pin 28 is mounted in the router 24 collet. Alignment pin 28 has a cylindrical section of suitable diameter to be received in the collet (such as, for instance ¼" diameter), a cylindrical section 30 of a first, larger diameter such as ½" and, projecting from section 30, a reduced diameter cylindrical section 32 of, for instance, 3/16". The factory supplied baseplate is removed from the router 24, and alignment pin 28 is fixed in router 24 collet so that the larger diameter portion 30 projects beyond the base 34 of router 24. A template, which may be a sheet of Mylar® plastic, or other transparent material, having a hole equal in diameter to the diameter of portion 30 of alignment pin 28 is placed over the alignment pin, against the base 34, and is temporarily fixed in place as, for instance, with adhesive tape 38 that bridges a notch 39. Template 36 is then precisely marked to indicate the location of the centers of threaded screw holes 40 in the base 34. This may be accomplished, for instance, using a second Mylar® or other clear material template 42 printed with circles of various sizes with marked centers, which sizes are in the range of diameters of typical screw holes 40. The circle on template 42 having a diameter matching or most closely matching that of screw holes 40 is placed over each screw hole, and a pointed pin 44 is then used to mark the exact center of each screw hole 40 in template 36.

Template 36 is then used as illustrated in FIG. 3 to mark the locations of baseplate screw holes 46. Baseplate 20 is positioned on scrap battens 48, and a washer 50 having an outer diameter appropriate to fit snugly in stepped center hole 22, and a centered hole that will receive the larger portion 30 of alignment pin 28 without play, is placed in center hole 22, and the larger diameter portion 30 of alignment pin 28 is placed inside washer 50. Previously marked template 36 is then placed on baseplate 20 around alignment pin 28, is temporarily fixed in place on baseplate 20 as, for instance, with adhesive tape 52 bridging notch 39, and a center punch 54 is used to mark the locations of screw holes 46. Countersunk screw holes 46 are then machined in baseplate 20 with a countersink bit 47 or by other suitable means such as a drill followed by a countersink.

Figure 5:
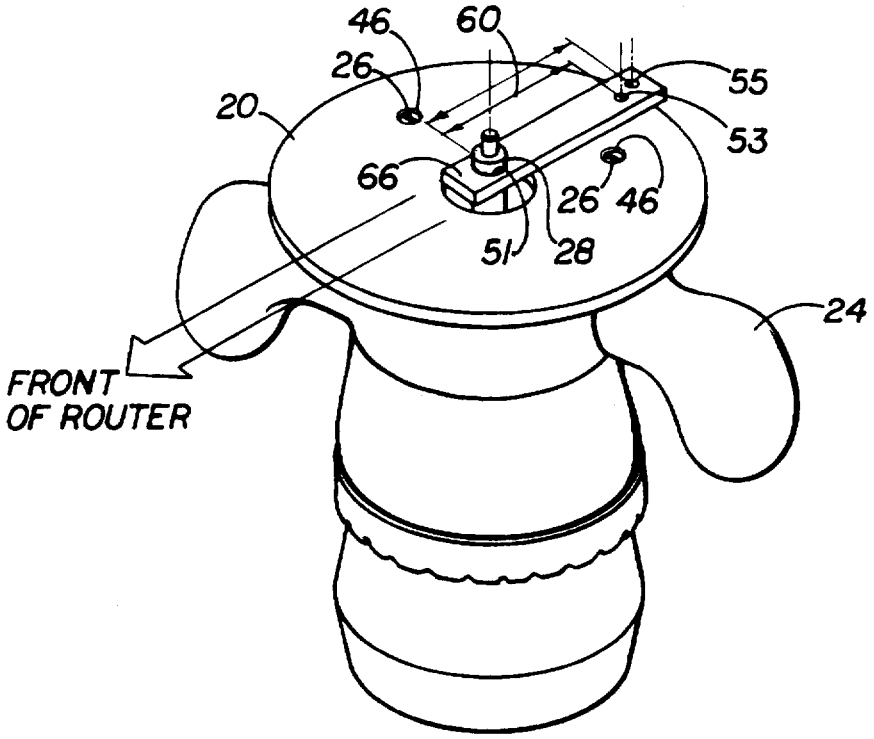
FIG. 5 is a perspective view of the baseplate of the present invention shown mounted on a router with an alignment pin and a trammel bar for locating peripheral holes in the baseplate.
Figure 6:
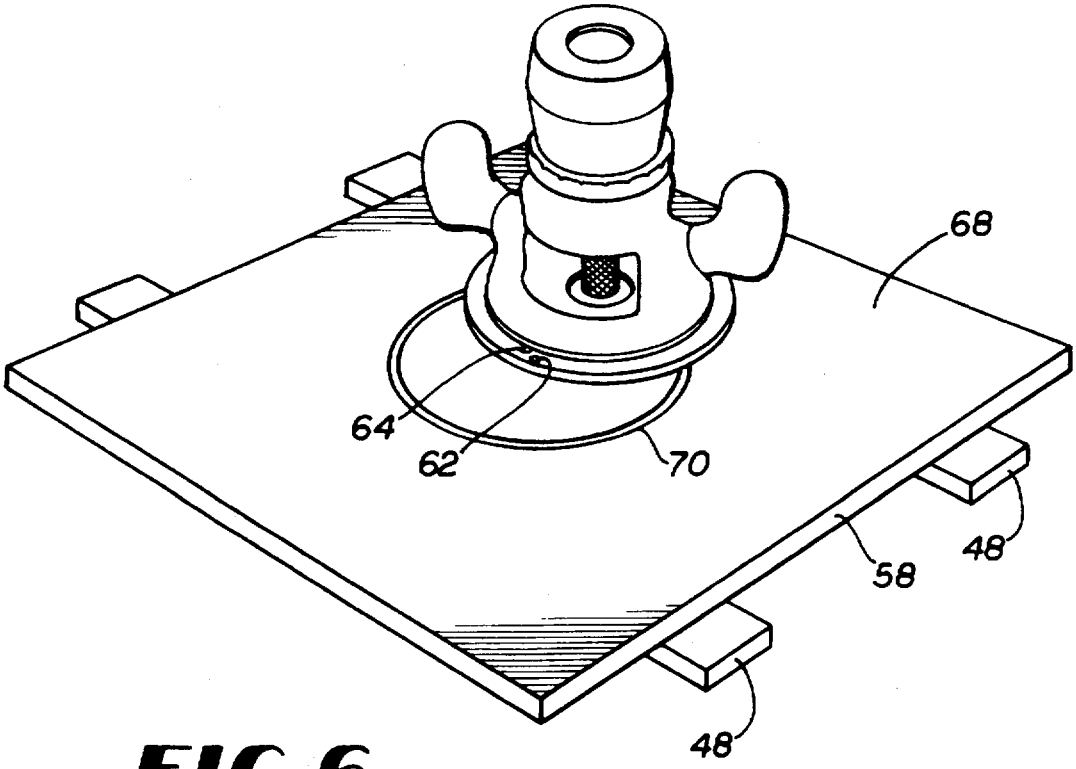
FIG. 6 is a perspective view of a router with the baseplate of the present invention being used to machine the underside of a router table top in accordance with the present invention.

With baseplate 20 now secured to router 24 with flat head screws 26 as illustrated in FIG. 5, necessary machining of baseplate 20 and router table top 58 in accordance with present invention may be accomplished as follows:

First, two holes of relatively small diameter, such 3/16", are drilled near the edge of baseplate 20. The first outer hole 62 hole is centered a distance 60 from the center of the baseplate 20 that is the radius of the baseplate minus the radius of a straight-sided router cutter that is to be used in the machining operation, plus a minimal clearance distance on the order of 0.004". A second, inner hole 64 is positioned a distance closer to the center of the baseplate equal to the width of the ledge 60 (FIG. 1) in top 58 on which baseplate 20 rests. The diameter of these two holes 62 and 64 drilled in baseplate 20 should accommodate without substantial play the smaller diameter portion 32 of alignment pin 28.

By way of example, with a round baseplate 20 nine inches in diameter, outer hole 62 may be a 3/16" diameter hole centered nominally one-quarter inch in from the outer edge of baseplate 20, which is 4¼ (plus 0.009) from the center of the baseplate 20. Inner hole 64 may be ½" in from the edge of baseplate 20, which is 4" from the center of baseplate 20. These inner and outer holes 62 and 64, respectively, may be machined in baseplate 20 with a help of a trammel bar 66, which can be a section of aluminum of bar stock ¾" wide and ¼" thick, with a ½" diameter hole 51 to receive the ½" diameter portion 30 of alignment pin 28 in one end of the stock and two 3/16" holes 53 and 55 centered 4" and 4¼" (plus 0.009), respectively, from the center of the ½" hole 51.

With the trammel bar 66 positioned as shown in FIG. 5 with its ½" diameter hole 51 positioned on alignment pin 28, 3/16" holes 62 and 64 may be drilled in baseplate 20 using the 3/16" holes 55 and 53 in trammel bar 66 as drill bushings.

Top 58 is machined by first drilling a hole 57 to receive portion 30 of alignment pin 28 (e.g. the ½" diameter portion) in the top 58 in the location at which the router 24 is to be centered. With the bottom side 68 of top 58 up, top 58 is then supported on two battens 48, and alignment pin 28 is positioned in hole 57 in top 58 with the small diameter portion 32 of pin 28 projecting up. Then, a straight side, square bottom router bit or cutter is mounted in the router 24 and adjusted to cut a depth equal to the thickness of the top 58 minus a little less than the thickness of baseplate 20. The radius of this router bit (i.e., one-half of its diameter) should be equal to the difference between the radius of the baseplate 20 and the distance from the center hole 51 in the trammel bar 66 to the center of the outer hole 55 in trammel bar 66, plus a clearence distance of on the order of 0.004", as mentioned above. A circular groove 70 is routed in the bottom side 68 of top 58 by positioning the inner hole 64 in router baseplate 20 on the projecting end 32 of alignment pin 28 and rotating the router 24 (while on) in a full circle around alignment pin 28. As will be understood from the foregoing description by one skilled in the art, this groove will have a diameter equal to the diameter of baseplate 20 plus a clearance distance on the order of a few thousandths of an inch.

Figure 7:
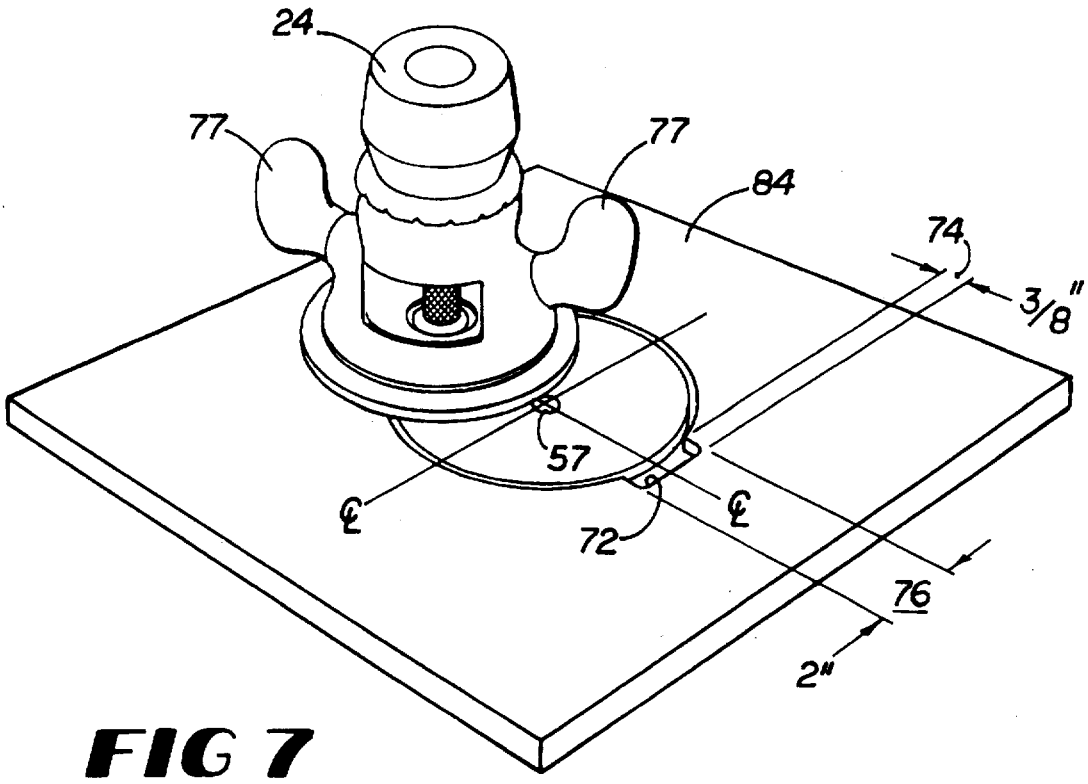
FIG. 7 is another perspective view of the underside of the router table top shown in FIG. 6 being machined to form notches in what will become the baseplate supporting ledge.
Figure 8:
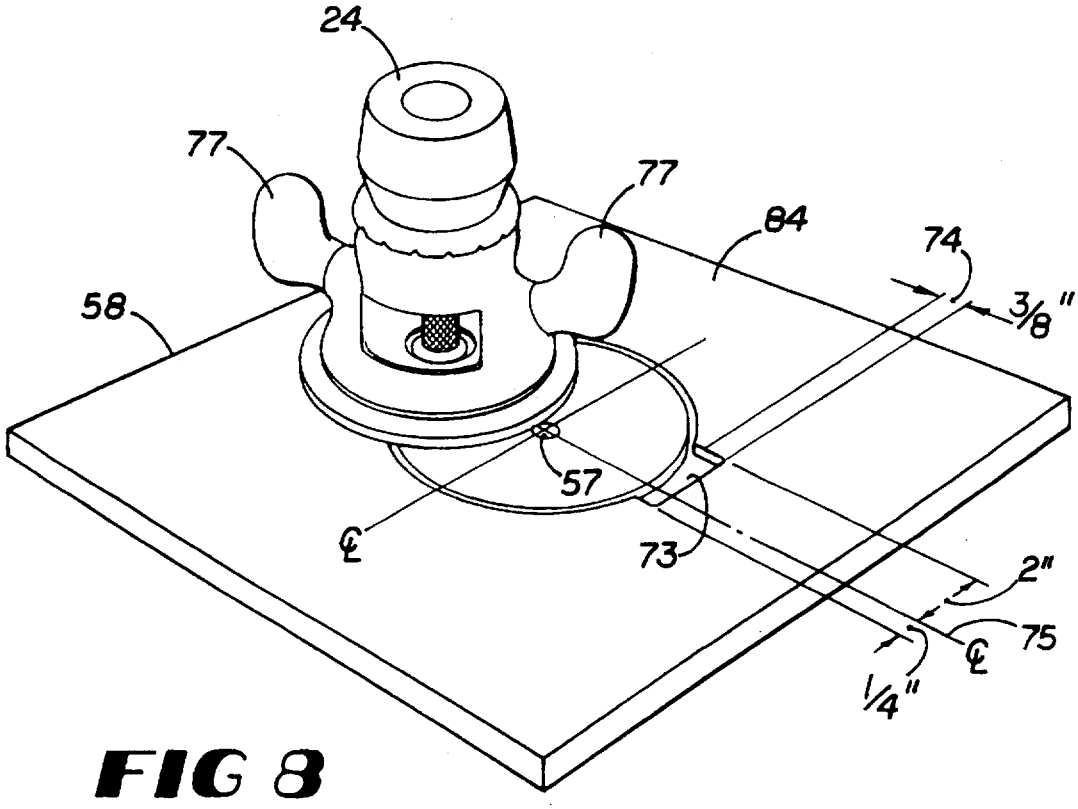
FIG. 8 is a perspective view of the underside of a router table top like FIG. 7, except that the notches are not directly opposite each other but are offset on the same side of a centerline.

With the top 58 still inverted, two generally opposed notches 72 of the same depth as groove 70 are machined as shown in FIGS. 7 and 8. These notches or cut-outs 72 (both of which are visible in FIG. 9) extend away from the groove 70 periphery by an amount, such as ⅜", that is a little greater than the width of ledge 60 and are approximately two inches in length 76. Expressed differently, notches 72 should typically eliminate two generally opposed portions of ledge structure, i.e., 180° apart from each other, each corresponding to approximately 20°–25° of arc along ledge 60. As an alternative to positioning of the notches or cut-outs 72 is exactly opposed locations as shown in FIG. 7, it may be desirable, in order to facilitate insertion and removal of the router baseplate 20, to position notches 73 somewhat off center as illustrated in FIG. 8. Providing more clearance to one side of the centerline 75 will sometimes provide more clearance for the router handles 77 when inserting or removing the router 24 from the table top 58.

Figure 9:
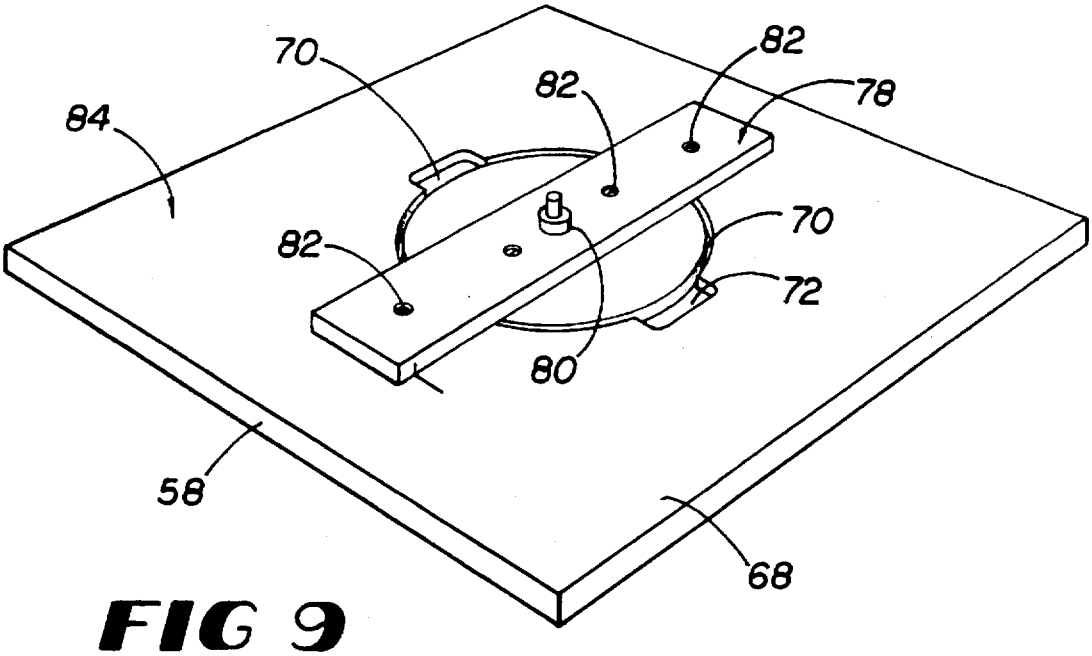
FIG. 9 is a fourth perspective view of the underside of the router table top illustrated in FIGS. 6 and 7 showing positioning thereon of a restraining bar.
Figure 10:
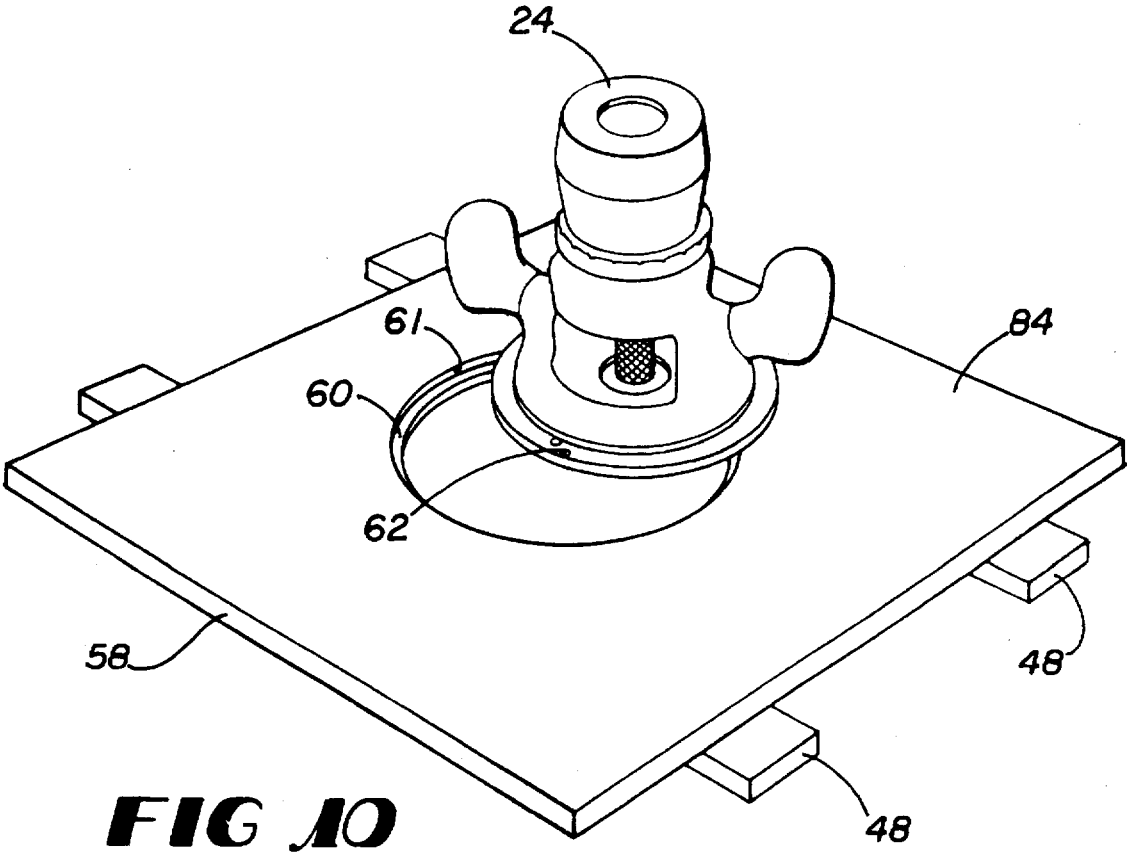
FIG. 10 is a perspective view of the top of the router table top shown in FIGS. 6, 7, 8 and 9 illustrating machining of the top to form the baseplate supporting ledge.
Figure 11:
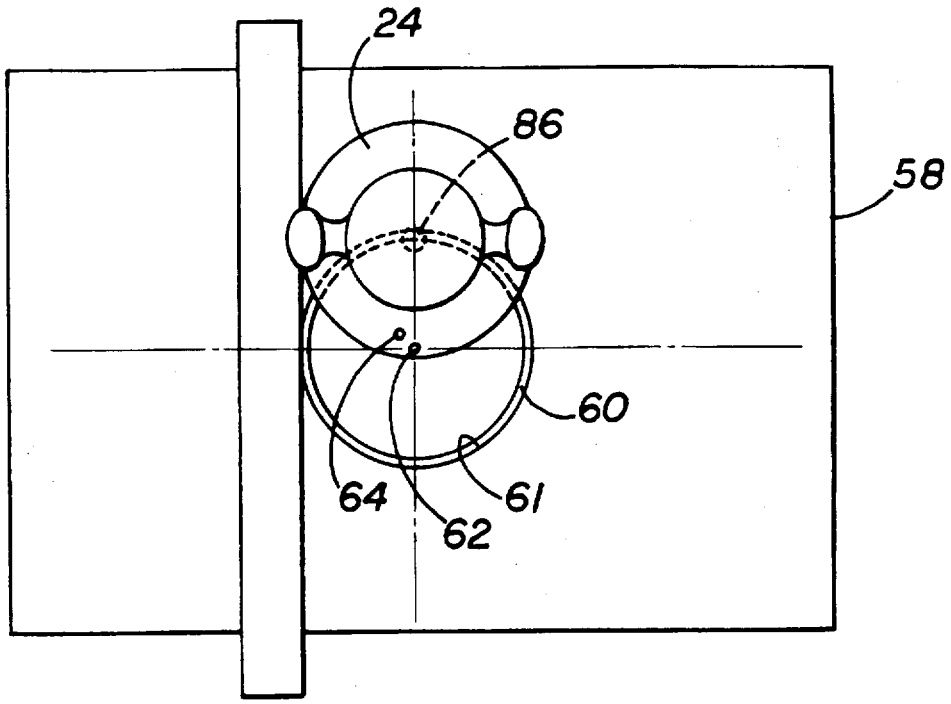
FIG. 11 is a top plan view of the router table top of the present invention shown with a router positioned to machine in the baseplate supporting ledge an arcuate recess to receive the rotation limiter.
Figure 12:
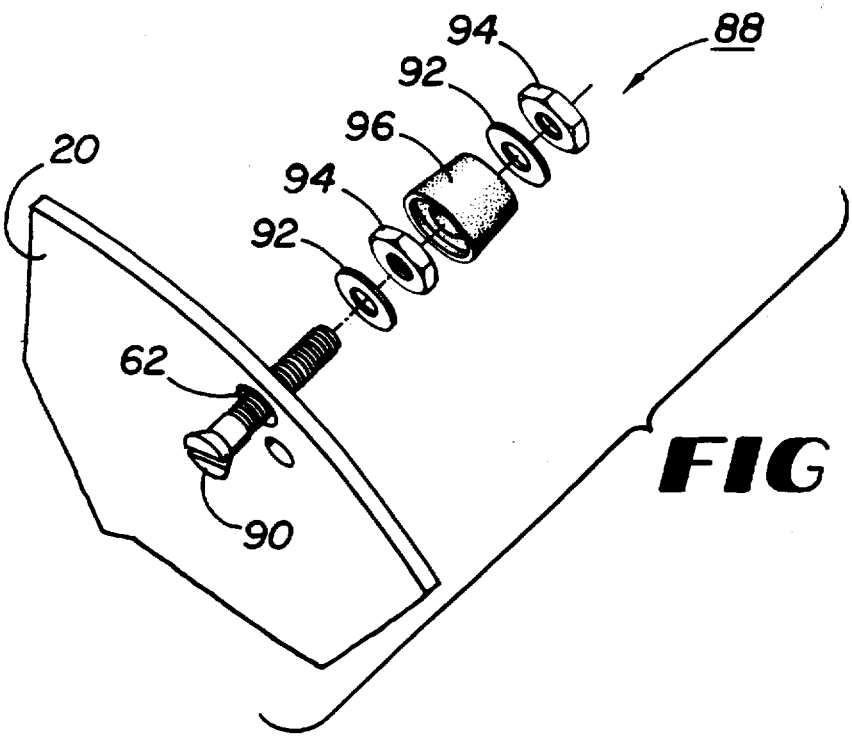
FIG. 12 is an enlarged, exploded perspective view of a portion of the baseplate of the present invention together with the components of the rotation limiter.

As is shown in FIG. 8, a restraining bar 78 with a centered hole 80 positioned on the larger portion 30 of alignment pin 28 is then temporarily affixed to the under side 68 of top 58 as, for instance, with screws 82 that pass through restraining bar 78 and into top 58 both inside of and outside of groove 70. Top 58 is then turned over so that its top side 84 is up, and it is positioned on battens 48, as illustrated in FIG. 9. Using the same diameter straight, square bottom router cutter used previously, the router is rotated about the center point by positioning outer hole 62 on smaller diameter portion 32 of alignment pin 28 with the router cutter adjusted to cut to a depth precisely equal to the thickness (such as ¼") of baseplate 20. This cut will cause a circular waste portion of top 58 to be cut entirely free of top 58 (although it is initially held in position by screws 82 passing through restraining bar 78). This cut will at the same time form ledge 60 with an adjacent wall 61 (shown in FIG. 1).

Finally, an arcuate recess 86 in ledge 60 should be cut equal in diameter to rotation on limiter 88. Among other methods, this can be done by plunging the router cutter through the ledge at a location at the back of the table top 58. Rotation limiter 88, which may have a number of alternative structures, may be a flat head screw 90 in countersunk outer hole 62 in baseplate 20 and projecting through baseplate 20, through a flat washer 92, through a hex nut 94, through a rubber bumper 96, through another flat washer 92 and through another nut 94.

Router 24 may now be used "free hand" with the baseplate 20 of the present invention attached. When it is desired to use router 24 in top 58, the router 24 and baseplate 20 assembly may be installed from the underside 68 of top 58 by tilting router 24 and baseplate 20 as illustrated in FIG. 1 in order to slide the baseplate 20 through the grooves 77 far enough for baseplate 20 to be positioned above the topside 84 of top 58 and then lowered onto ledge 60. As baseplate 20 is lowered onto ledge 60, rotation limiter 88 is positioned in arcuate recess 86, which prevents base 20 from rotating within top 58. Further tightening of screws 90 while outer nut 94 is restrained will cause rubber bumper 96 to expand, thus pushing against arcuate recess 86 and eliminating any free play between baseplate 20 and wall 61 adjacent to ledge 60. The degree of expansion of the rubber bumper 96 should be sufficiently limited to allow the insertion and removal of baseplate 20 from top 58 without loosening screw 90.

As will be understood by those skilled in the art, numerous modifications and changes can be made to the embodiment of the present invention described above and illustrated in the accompanying drawings without departing from the spirit of the invention or the scope of the following claims.

For instance, router baseplate 20 could be made of steel, aluminum or other metals or metal alloys instead of plastic. Additionally, router table top 58 could be steel or another metal or metal alloy. Furthermore, ledge 60 could be fabricated and attached to top 56 rather than being formed from the same material as top 58 and machined in the course of producing top 58. For example, a series of suitably located clips could substitute for ledge 60. Similarly, other rotation limiters 88 could be used. For instance, limiter 88 could be a pin fixed in ledge 60 that is received in a hole in baseplate 20 when baseplate 20 is seated on ledge 60.

Although router baseplate 20 is described above and illustrated in the drawings as being round, it can also be other shapes, particularly but not exclusively including square and rectangular. If router baseplate 20 is square or rectangular, it generally is possible to practice the present baseplate and router table top invention with a narrow ledge 60 that is continuous around the entire perhiphery or wall 61 of the opening in table top 58 within which the router baseplate 20 is received. Such a continuous ledge 60 without notches or cutouts 72 or 73 is possible because it is possible to manouver the baseplate into position by rotating it slightly in the process of passing it though the table top. Alternatively, opposed notches or cutouts can be be located in a pair of opposed comers of the opening through the table top, which will facilitate easy insertion and removal of the router 24 and square or rectangular baseplate assembly without the need for rotation.

We claim:

1. A router table top, comprising a table top plate penetrated by an opening for receiving a router baseplate, the opening comprising a hole sufficiently larger than the baseplate to receive the baseplate, and structure for supporting at least a portion of the baseplate when the baseplate is positioned within the hole substantially flush with the top side of the table top plate, which structure is not present in at least two opposed regions adjacent to the hole so that the baseplate while attached to a router can pass through the top plate and be seated on the supporting structure by tilting the baseplate relative to the top of the table top plate as the baseplate passes through the regions.

2. The router table top of claim 1, further comprising means for limiting movement of the baseplate when the baseplate is positioned within the hole substantially flush with the top side of the table top plate.

3. The router table top of claim 1, wherein the structure for supporting the baseplate is a ledge.

4. The router table top of claim 3, wherein the ledge defines a recess for receiving a rotation limiting pin approximately equal in size to the size of the recess.

5. A router baseplate for affixation to a router base during use of the router both in free hand operation and in a router table top, comprising:

a round, flat plate penetrated by a centered hole through which router cutters may extend, the plate having a first side for contact with the router base, a second side for contact with a workpiece, and a peripheral edge, and means for limiting movement of the baseplate when it is used in the router table.

6. The router baseplate of claim 5, wherein the movement limiting means is a pin projecting from the first side of the plate near the plate edge.

7. The router baseplate of claim 6, wherein the pin is a fastener securing a resilient member.

8. The router baseplate of claim 7, wherein the fastener is a screw and the resilient member is a rubber bumper.

9. The router baseplate of claim 5, wherein the plate is made of phenolic material.

10. The router baseplate of claim 1, wherein the centered hole is a stepped hole.

11. A router baseplate and table top assembly, comprising:

for mounting on a router base, a round, flat baseplate penetrated by a centered hole through which router cutters may extend, the baseplate having a first side for contact with the router base, a second side for contact with a workpiece, and a peripheral edge, a table top plate penetrated by an opening for receiving the baseplate, the opening comprising a round hole sufficiently larger in diameter than the plate diameter to receive the plate snugly, and structure for supporting at least a portion of the baseplate when the baseplate is positioned within the hole substantially flush with the top side of the table top plate, which supporting structure is not present in at least two generally opposed regions adjacent to the hole so that the baseplate can pass through the top plate and be seated on the supporting structure by tilting the baseplate relative to the top of the table top plate as the baseplate passes through the regions, and a means for limiting movement of the baseplate when it is used in the router table top plate.

12. The assembly of claim 11, wherein the structure for supporting the baseplate is a ledge adjacent to the hole in the table top plate, and the movement limiting means is a pin attached to the baseplate and received in a recess in the ledge.

13. The assembly of claim 11, wherein the centered hole is a stepped hole.

14. A method for producing a router baseplate and table top assembly utilizing a router having a collet and a router base penetrated by screw holes, the method comprising the steps of:

(a) mounting a round, flat router baseplate disk having a radius and a centered, first hole on the router base so that the baseplate disk is centered on the router collet, (b) machining a second hole in the disk a first distance from the center of the collet that is near the peripheral edge of the disk, (c) machining a third hole in the disk a second distance from the center of the collet, which second distance is smaller than the first distance, (d) machining a first hole in a flat plate to be used as the router table top in the location at which it is desired that the router collet be centered, (e) positioning a first pin in the first hole in the table top plate, (f) positioning the disk against the bottom side of the table top plate with a portion of the pin received in the third hole in the disk and, in the router collet, a straight side router cutter equal having a radius less than the radius of the disk minus the first distance, and rotating the router, while on, about the first pin to cut a groove partway through the table top plate, (g) cutting two generally opposed notches in the table top plate adjacent to the location of the groove cut in step (f), (h) positioning the disk against the top side of the table top plate with a portion of the pin received in the second hole in the disk and, in the router collet a straight-side router cutter, and rotating the router, while on, about the pin to cut a groove partway through the table top plate to form an opening within which the baseplate may be received and a ledge on which the baseplate may be supported.

15. The method of claim 14, wherein the radius of the baseplate disk is 4½ inches, the second hole is centered 4¼ inches from the center of the disk and the third hole is centered 4 inches from the center of the disk.

16. The method of claim 14, wherein the second and third baseplate holes are machined utilizing a trammel bar having:

(a) a first hole sized to fit over a second cylindrical pin received in the router collet, and second and third holes centered a distance away from the center of the first hole equal to the first and second distances, respectively.

17. The method of claim 14, wherein the step of mounting the baseplate disk on the router base comprises the steps of:

(i) mounting a cylindrical pin in the router collet, (ii) positioning against the router base a sheet of template material having a hole sized to receive the pin without substantial play, (iii) marking on the template the locations of the screw holes in the router base, (iv) centering the template on the baseplate utilizing a pin passing through the baseplate center hole and the hole in the template, (v) marking the screw hole locations on the baseplate by reference to the locations marked on the template, and (vi) machining screw holes in the baseplate at the marked locations.

18. The method of claim 17, wherein step (iii) is preceded by the step of locating the centers of screw holes in the router base utilizing a second clear template having thereon a plurality of different circle sizes with marked centers.

19. A method for mounting a baseplate having a center hole on a router base, comprising the steps of:

(i) mounting a cylindrical pin in the router collet, (ii) positioning against the router base a sheet of template material having a hole sized to receive the pin without substantial play, (iii) marking on the template the locations of the screw holes in the router base, (iv) centering the template on the baseplate utilizing a pin passing through the baseplate center hole and the hole in the template, (v) marking the screw hole locations on the baseplate by reference to the locations marked on the template, (vi) machining screw holes in the baseplate at the marked locations, and (vii) passing screws through the screw holes into the router base.

20. A method for installing a router mounted on a round baseplate in a router table top from the bottom of the table top, wherein the table top is penetrated by an opening for receiving the baseplate, the opening comprising a round hole sufficiently larger in diameter than the baseplate diameter to receive the plate snugly, and the table top includes structure for supporting at least a portion of the baseplate when the baseplate is positioned within the opening substantially flush with the top side of the table top plate, which supporting structure is not present in at least two generally opposed regions adjacent to the opening so that the baseplate can pass through the table top, comprising the steps of:

(a) with the router attached to the baseplate, positioning the baseplate adjacent to the under side of the table top and laterally offset somewhat from the table top opening, (c) tilting the baseplate relative to the top of the table top plate and passing the baseplate through the generally opposed regions while maintaining the tilted relationship until the diameter of the baseplate transverse to its direction of movement passes beyond the widest region of the table top opening, (d) untilting the baseplate and moving the baseplate generally opposite the direction of its movement in step (c) above until the baseplate is concentric with the tabletop opening, and (e) seating the baseplate in the table top opening resting on the ledge and substantially flush with the top of the table top.

21. The router installation method of claim 20, further comprising the step of engaging, between the baseplate and table top, means for preventing the baseplate from rotating within the table top during use of the router.

22. The router installation method of claim 21, wherein the rotation preventing means comprises a threaded fastener surrounded by a resilient collar that is received in a recess in the table top and which collar may be expanded by tightening the fastener so that the baseplate is urged against structure in the table top.

23. A method for installing a router mounted on a baseplate in a router table top from the bottom of the table top, wherein the table top is penetrated by an opening for receiving the baseplate, the opening comprising a hole sufficiently larger than the baseplate to receive the plate snugly, and the table top includes structure for supporting at least a portion of the baseplate when the baseplate is positioned within the opening substantially flush with the top side of the table top, comprising the steps of:

(a) with the router attached to the baseplate, positioning the baseplate adjacent to the under side of the table top and laterally offset somewhat from the table top opening, (c) tilting the baseplate relative to the top of the table top plate and passing the baseplate through the table top opening while maintaining the tilted relationship and slightly rotating the baseplate until the largest portion of the baseplate passes beyond the widest region of the table top opening, (d) untilting the baseplate and moving the baseplate generally opposite the directions of its movement in step (c) above until the baseplate can be seated in the tabletop opening, and (e) seating the baseplate in the table top opening resting on the supporting structure and substantially flush with the top of the table top.

* * * * *